United States Patent [19]

Fuller

[11] 4,288,286

[45] Sep. 8, 1981

[54] KRAFT MILL RECYCLE PROCESS

[75] Inventor: Willard A. Fuller, Grand Island, N.Y.

[73] Assignee: Hooker Chemicals & Plastics Corp., Niagara Falls, N.Y.

[21] Appl. No.: 126,594

[22] Filed: Mar. 3, 1980

Related U.S. Application Data

[63] Continuation of Ser. No. 967,933, Dec. 8, 1978, abandoned, which is a continuation of Ser. No. 753,656, Dec. 22, 1976, abandoned.

[51] Int. Cl.[3] ..... D21C 11/04

[52] U.S. Cl. ..... 162/30 R; 162/30 K; 162/DIG. 8; 423/207; 423/232; 423/DIG. 3

[58] Field of Search ..... 162/30 R, 30 K, DIG. 8; 423/207, 522, 560, 478, 480, 232, DIG. 3

[56] References Cited

U.S. PATENT DOCUMENTS

| | | | |
|---|---|---|---|
| 3,210,235 | 10/1965 | Ferrigan et al. | 162/30 K |
| 3,366,534 | 1/1968 | Rapson | 162/30 K |
| 3,508,863 | 4/1970 | Kiminki et al. | 162/30 R |
| 3,542,511 | 11/1970 | Shah | 423/522 |
| 3,841,961 | 10/1974 | Saiha | 162/29 |
| 3,954,552 | 5/1976 | Lukes et al. | 162/30 K |

FOREIGN PATENT DOCUMENTS

| | | | |
|---|---|---|---|
| 955707 | 10/1974 | Canada | 162/DIG. 8 |

*Primary Examiner*—William F. Smith
*Attorney, Agent, or Firm*—William G. Gosz

[57] ABSTRACT

A cellulosic pulp and bleaching process is described. The process integrates two cycles, one is a digestor liquor cycle and the other is a sulfur cycle.

The digestor liquor cycle comprises the steps of digesting a fibrous cellulosic feed to form a pulp, separating the pulp and bleaching it in at least one stage with chlorine dioxide, evaporating and burning the remaining waste liquor to form a smelt, dissolving the smelt to form a green liquor and utilizing the green liquor, after recausticizing, as at least a portion of the feed stock for the digestor step.

The sulfur cycle of the present invention utilizes a portion of the green liquor of the digestor liquor cycle. The green liquor is carbonated to form a bicarbonate which is then stripped of $H_2S$. The $H_2$ S is converted into $H_2SO_4$ and utilized as a feed stock to a chlorine dioxide generator. The chlorine dioxide generator utilizes $H_2SO_4$ as feed stock and produces $Na_2SO_4$ as a by-product. The $Na_2SO_4$ by-product from the chlorine dioxide generator is furnaced in common with the evaporated waste pulping liquor from the digestor liquor cycle to form a common smelt, which is dissolved to form a green liquor, a portion of which is used in the sulfur cycle and a portion of which is used in the digestor cycle.

12 Claims, 2 Drawing Figures

KRAFT MILL RECYCLE PROCESS

This is a continuation of application Ser. No. 967,933, filed Dec. 8, 1978, now abandoned, which is a continuation of application Ser. No. 753,656, filed Dec. 22, 1976, now abandoned.

BACKGROUND OF THE INVENTION

The present invention relates to the production of bleached cellulosic fibrous pulp. More particularly, the present invention relates to a method of producing bleached fibrous cellulosic pulp in which the chemical compounds used and formed in the various steps and stages are utilized to maximum efficiency with a minimum of loss and resulting pollution by the recovery and reuse of products previously passed as waste from pulp bleaching processes.

In the conventional Kraft process, raw cellulosic fibrous material, generally wood chips, is digested, by heating, in a pulping liquor, (white liquor) which contains sodium sulfide and sodium hydroxide as the active pulping chemicals. The digestion provides a pulp and spent pulping liquor (black liquor). The black liquor is separated from the pulp by washing in a brown stock washer and the pulp utilized as feedstock in a bleach plant for brightening and purification operations.

The black liquor is then concentrated, usually by evaporating, and the concentrated black liquor burned in a reducing furnace to yield a smelt containing primarily sodium carbonate and sodium sulfide.

The smelt is then dissolved in water to yield a raw green liquor which may be clarified to remove undissolved solids. The green liquor is then causticized, usually by treatment with CaO to convert sodium carbonate to sodium hydroxide. The resulting liquor is white liquor and is useful in the initial digestion step to provide at least a part of the pulping liquor.

The foregoing sequence or cycle is well known and is referred to herein as the digestor liquor cycle.

Bleach plant operations generally involve a sequence of brightening and purification steps which may be combined with washing steps. The brightening steps generally involve the use of bleaching agents, such as chlorine or chlorine dioxide. The purification steps involve washings and treatment with sodium hydroxide solution, caustic extraction.

A particular bleaching sequence which finds use in one mode of the present invention involves an initial bleaching of the pulp with an aqueous solution containing chlorine dioxide and chlorine, an intermediate washing, a caustic extraction using aqueous sodium hydroxide solution, a further washing, a bleaching with an aqueous solution of chlorine dioxide, another washing, a further caustic extraction using aqueous sodium hydroxide, an additional washing, a final bleaching with chlorine dioxide solution and a final washing. These are the so-called $D_cEDED$ or D/C EDED sequences.

A common source of chlorine dioxide for the bleaching operation is a chlorine dioxide generator which produces chlorine dioxide, usually as an aqueous solution of chlorine dioxide and chlorine by the reduction of a chlorate salt, e.g., sodium chlorate. Such chlorine dioxide generators utilize a feed of $H_2SO_4$ which is reacted with a mixture of sodium chlorate with some sodium chloride to produce a chlorine dioxide bleaching product and a sodium sulfate (saltcake) by-product.

BRIEF DESCRIPTION

The present invention utilizes the digestor liquor cycle, as described in the foregoing, in tandem with a sulfur cycle. The sulfur cycle utilizes a portion of the green liquor of the digestor cycle and has in common the furnacing and smelt dissolving steps of the digestor liquor cycle. The green liquor utilized in the sulfur cycle is carbonated, using stack gas, producing three phases. One is a gas phase of substantially pure hydrogen sulfide. One is a solid phase of sodium bicarbonate. The remaining phase is an aqueous liquid phase containing the soluble impurities of the green liquor, mainly chlorides. The hydrogen sulfide phase is converted into $H_2SO_4$ by oxidation and the product utilized as feedstock into a chlorine dioxide generator. The solid phase of $NaHCO_3$ may be converted by causticizing to yield a relatively pure feedstock for caustic extraction steps in a bleaching sequence or may be furnaced to yield additional smelt. The aqueous phase, high in chlorides, is suitably used as feed into the chlorine dioxide generator as a source of chlorides or may be fed to a salt extractor, in either case, removing chlorides from the operation.

The sodium sulfate by-product of the chlorine dioxide generator is furnaced in common with the evaporated or concentrated black liquor to form a common smelt and subsequently additional green liquor, this completing the sulfur cycle.

It is contemplated that the cabonation reactions of the present invention proceed as follows; however, it is to be understood that the reactions are shown for clarity of understanding and are not limiting to the invention as it is to be considered that the green liquor and flue gas reactants are highly impure products.

$$Na_2S + H_2O + CO_2 \rightarrow NaHS + NaHCO_3 \downarrow$$

$$Na_2S + 2H_2O + CO_2 \rightarrow 2NaHCO_3 \downarrow + H_2S$$

$$Na_2S + H_2S \rightarrow 2NaHS$$

$$Na_2CO_3 + H_2O + CO_2 \rightarrow 2NaHCO_3 \downarrow$$

The present invention also contemplates a balanced mill operation utilizing the digestor liquor and sulfur cycles in tandem.

DETAILED DESCRIPTION

The present invention will be described more in detail by reference to and discussion of the drawings.

The chemical consumptions and requirements given in the following descriptions are given in pound equivalents required to produce one ton of air-dried pulp.

Figure 1:
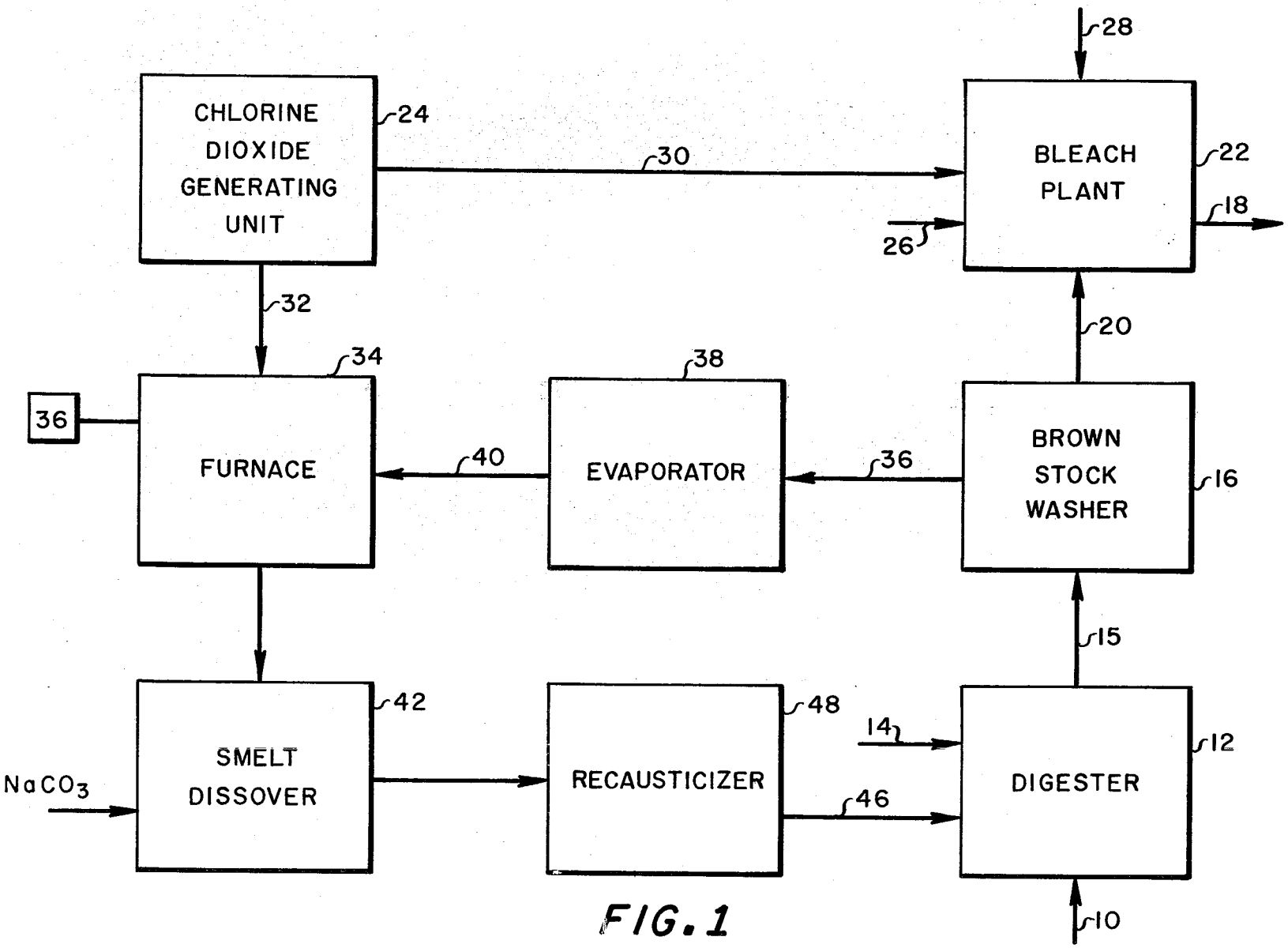
FIG. 1 is a schematic flow sheet illustrating a typical pulp mill operation utilizing a digestor liquor cycle, a bleach plant, and a chlorine dioxide generator to produce bleaching solutions.

Looking now to FIG. 1, the basic digestor liquor cycle is shown in combination with a chlorine dioxide generator. Thus, fibrous cellulosic material, e.g., wood chips, are fed by line 10 into the digestor 12 wherein the wood chips are digested with a pulp liquor fed by line 14 containing NaOH and $Na_2S$ as the main pulping chemicals. Miscellaneous losses in the digestor amount to about 24.5 pounds of $Na_2O$ equivalent, about 4.5 pounds of sulfur and about 0.6 pounds of sodium hydroxide, based upon one ton of air-dried pulp product from the plant. The pulp liquor fed by line 14 contains about 286 pounds sodium sulfide, about 684 pounds sodium hydroxide, about 7 pounds sodium sulfate, about 70 pounds sodium carbonate, about 0.1 pound sodium chloride and about 5,700 pounds of water.

The resulting pulp and spent pulping liquor are fed through line 15, and the pulp washed and separated from the waste pulping liquor in brown stock washer 16. The washed but unbleached pulp is fed by line 20 to bleach plant 22 wherein the pulp is subjected to a series of bleaching and purification processes involving, in at least one stage, the use of chlorine dioxide. These processes may include additional bleaching or purification steps utilizing a caustic extraction wherein aqueous solutions of sodium hydroxide are fed through line 26. Generally, the pulp is washed during the bleach plant operation, typically after each bleaching or caustic extraction step by water fed through line 28. The spent wash water from the bleach plant washing operations, together with the spent chemicals from the bleaching and caustic extraction steps, provide the plant bleaching effluent in line 18.

The bleach plant effluent in line 18, a potential loss and pollutant, might be considered to be added to the spent pulp liquor in line 36; however, this procedure is not feasible because substantial amounts of chlorides would be added to the pulp digestion system which are a cause of equipment erosion and, since chlorides do not react in this cycle, they accumulate as large amounts of non-useful materials in the cycle. As shown in the remaining Figures, the present invention alleviates the problem of build-up of unusable chlorides in the digestor liquor cycle and further produces a sodium bicarbonate product which may readily be converted into sodium hydroxide and returned as a useful component to either the digestor liquor cycle or to the bleach plant operation.

A chlorine dioxide generating unit 24 utilizes $H_2SO_4$, $NaClO_3$ and NaCl as feedstock and produces chlorine dioxide which is fed through line 30 into bleach plant 22. Typically, about 24 pounds of NaCl, about 40.7 pounds of $NaClO_3$ and about 95 pounds of $H_2SO_4$ are utilized to produce about 24.5 pounds of chlorine dioxide and about 15.2 pounds of chlorine. About 56.3 pounds of salt cake, $Na_2SO_4$ are produced and are fed through line 32 to furnace 34. Although furnace 34 is equipped with precipitator 36, there is stack loss of about 2.90 pounds $Na_2O$ equivalent, 3.70 pounds of sulfur and about 0.3 pound NaCl.

The waste pulp liquor is fed by line 36 to evaporator 38, and the evaporator materials fed through line 40 to furnace 34. The smelt produced by furnace 34 is fed into smelt dissolver 42 to produce green liquor which is butted by the addition of soda ash, in the amount of about 116 pounds, and recausticized in recausticizer 48. The recausticized solution is fed by line 46 into digestor 12, thus completing the digestor liquor cycle.

Figure 2:
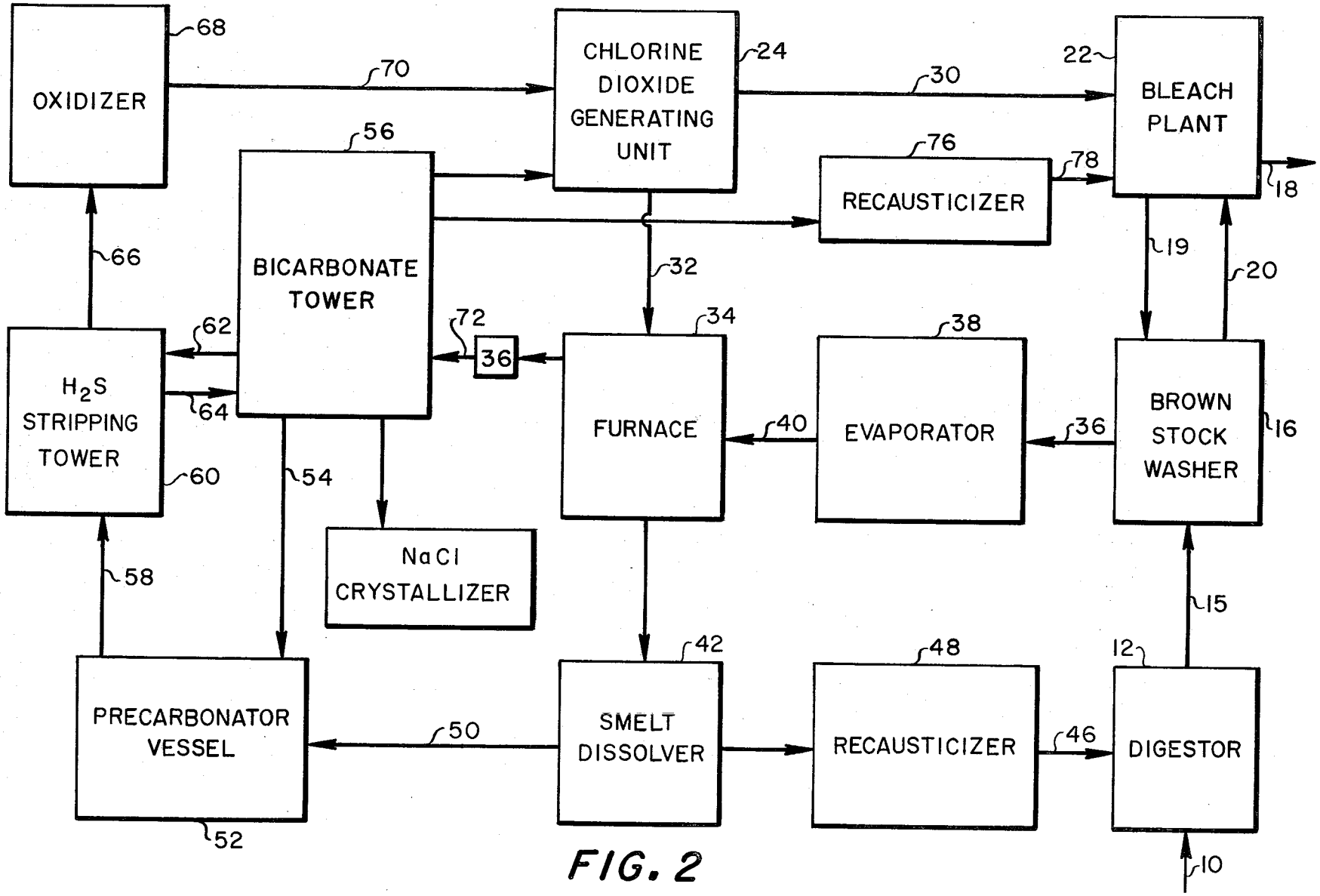
FIG. 2 is a schematic flow sheet illustrating a pulp mill operation utilizing a digestor liquor cycle in combination with a sulfur cycle, and a bleach plant. In this mode a portion of the sodium bicarbonate produced is causticized and utilized in the bleaching operation and effluent from the carbonating tower is utilized as feed to the chlorine dioxide generator.

Looking now to FIG. 2, this figure shows the digestor liquor cycle of FIG. 1 in tandem with a sulfur cycle. A quantity of green liquor containing $Na_2S$ equivalent to about 94 pounds $H_2SO_4$ (the requirement for chlorine dioxide generator 24 based upon one ton of air-dried pulp mill product) is withdrawn from smelt dissolver 42 through line 50 and fed into precarbonation vessel 52. The precarbonation vessel receives feed of $CO_2$ gas through line 54 from bicarbonate tower 56. The precarbonated material is fed through line 58 into $H_2S$ stripping tower 60 where additional bicarbonate solution or slurry is fed through line 62 and exhausted solution is returned through line 64 to bicarbonate tower 56. Substantially pure $H_2S$ in gaseous form is fed by line 66 into oxidizer 68 to produce $H_2SO_4$ or $H_2SO_3$. The sulfuric acid thus produced is fed through line 70 as feedstock into chlorine dioxide generator 24, thus completing the sulfur cycle.

Looking now in more particular to bicarbonating tower 56, an integral part of the present invention, this tower, as a source of $CO_2$, receives stack gas through line 72, although it will be understood that $CO_2$ from any source may be used. The carbonation reaction precipitates a relatively pure $NaHCO_3$ product which may be easily separated by elutriation and recausticized by treatment with CaO to yield a substantially pure NaOH product for use in bleach plant 22 or to butt or produce additional pulping liquor. A portion of the carbonated product is utilized in $H_2S$ stripper 60 to liberate $H_2S$. The mother liquor from elutriation, mainly chlorides, is utilized at least in part as a source of chlorides for chlorine dioxide generator 24.

It may be noted at this point that bleach plant effluent, especially extraction effluent containing large amounts of chlorides may now be returned to the digestor liquor cycle as the chlorides are removed in the sulfur cycle and utilized as feed into the chlorine dioxide generator. Thus extraction effluent is returned from bleach plant 22 through line 19 to brown stock washer 16 and utilized as wash make-up.

The stack gases fed into bicarbonating tower 56 by line 72 from precipitator 36 contain about 15 percent by weight of $CO_2$. The entering $CO_2$ reacts with $Na_2S$ and $NaCO_3$ to produce $NaHCO_3$. Although bicarbonating tower 56 may operate at pressures from atmosphere to about 100 p.s.i.a. and at temperatures of from about 25° to about 100° C., a more practical range is atmospheric pressure to about 30 p.s.i.a. and about 50° to about 80° C. The main products of bicarbonating tower 56 are $NaHCO_3$ and a chloride feedstock for chlorine dioxide generator 24. In precarbonization vessel 52, green liquor from line 50 is treated with a solution of $NaHCO_3$ containing some $Co_2$ from bicarbonating tower 56. The desired reaction is to convert $Na_2S$ to NaHS without liberation of $H_2S$. This treatment is preferably carried out in a closed vessel at atmospheric pressure to minimize formation and loss of $H_2S$. The treated solution from precarbonator vessel 52 is fed by line 58 to stripping column 60 where the mixture is stripped, preferably by use of steam to release $H_2S$ in concentrated and substantially pure form. $H_2S$ is removed from the solution preferably by flash or vacuum stripping in which is fed solution containing $NaHCO_3$ by line 62 and exhausted solution containing $Na_2CO_3$ returned to bicarbonating tower 56 through line 64. Steam is preferably used as the stripping agent since a recovery of concentrated $H_2S$ gas can be effected simply by condensing the steam from the mixture of steam and $H_2S$.

The bicarbonating and stripping operations may be carried out in any type of equipment conventionally employed for gas absorption or stripping operations. Thus packed columns, plate columns, spray columns and continuous liquid phase columns are aptly suited to use. Agitated gas dispersion equipment may be advantageously used in the bicarbonating tower.

The liberated $H_2S$ is fed by line 66 to sulfuric acid plant 68 where the $H_2S$ is oxidized to produce $SO_3$ which is dissolved in a $H_2O$ solution to yield a $H_2SO_4$ product.

The $H_2SO_4$ produced is fed into chlorine dioxide generator 24 as feedstock. The salt-cake produced as a by-product from chlorine dioxide generator 24 is fed by line 32 to furnace 34 where it is furnaced in common with evaporated waste pulping liquor from evaporator 38.

In this mode of the invention, the excess $NaHCO_3$, about 200 pounds, is fed to a recausticizer 76 which converts the $Na_2CO_3$ into about 95 pounds of NaOH which is suitably fed through line 78 to bleach plant 22 and utilized in the pulp bleaching operation, although, if required, can be utilized to butt or produce pulp liquor.

Because of losses in the various stages of a Kraft mill operation, additional alkali soda (NaOH) and, in some cases, additional sulfur make up are required. As much as possible, this is done by the utilization of salt cake, but, because of its sulfur content, salt cake usually cannot be fully utilized, and additional alkali soda will need to be acquired. It will be noted that, in the process of FIG. 2, the alkali soda in excess is produced from salt cake without the addition of excessive amounts of sulfur being added to the digestor liquor.

It will be understood that many modifications to the present invention may be made, for example, various bleach sequences will yield effluents of varying compositions, or other paper making activities which have chemical requirements or by-products, which may be provided for by modification of the present process.

Economic or environmental factors may also be provided for by modifications, for example, in one mode of operation of the present invention a pulp bleaching sequence of $D_cEDED$ is utilized in bleach plant 22. When this sequence is used, the entire effluent from the bleach plant may be returned to brown stock washer 16, thus utilizing and thereby eliminating all effluent from the bleach plant operation. If desired, a salt crystallizer may be installed in connection with bicarbonating tower 56 and sodium chloride in substantially pure form recovered.

The following table gives comparative chemical requirements and credit balances for the process of the present invention when operated under the conditions of FIG. 2 (Column A) and under a total recycle of bleach plant effluent (Column B) as compared with a plant operating under a normal digestor liquor cycle (Column C). The requirements and credits are given in pounds of chemicals required to produce one ton of air-dried pulp.

TABLE 1

| | A | B | C |
|---|---|---|---|
| Requirements | | | |
| $H_2SO_4$ | — | — | 38.8 |
| $NaClO_3$ | 96.8 | 96.8 | 40.7 |
| NaCl | — | — | 24.0 |
| $Na_2CO_3$ | 94.2 | 116.0 | 40.8 |
| NaOH | — | — | 95.0 |
| $Na_2SO_4$ | 46.7 | 43.9 | — |

TABLE 1-continued

| | A | B | C |
|---|---|---|---|
| Credits | | | |
| $Na_2SO_4$ | — | — | 6.3 |
| NaCl | — | 39.0 | — |

What is claimed is:

1. An integrated process for pulping and bleaching cellulosic material and sulfur recovery comprising the steps of:

(a) digesting a fibrous pulp, (b) separating the fibrous pulp and waste liquor produced by said digesting step, (c) evaporating and burning said waste liquor in a furnace to form a smelt and stack gas, (d) dissolving said smelt to form a green liquor and causticizing a portion of said green liquor for use in (a), (e) treating a portion of said green liquor with a solution of $NaHCO_3$ containing $CO_2$ in a closed vessel to produce a precarbonate solution containing NaHS, (f) stripping said precarbonate solution to produce hydrogen sulfide and a solution of $Na_2CO_3$, (g) utilizing the $Na_2CO_3$ solution from (f) and $CO_2$ to produce a solution of $NaHCO_3$ and a chloride stream, and utilizing a portion of the $NaHCO_3$ solution as a feed material in (e), and a further portion of the $NaHCO_3$ solution as a feed material in (f), (h) oxidizing at least a portion of said hydrogen sulfide to produce $H_2SO_4$, (i) utilizing at least a portion of said $H_2SO_4$ as feed stock in a chlorine dioxide generator to react with an alkali metal chlorate and an alkali metal chloride to produce $ClO_2$ and an alkali metal sulfate, and (j) utilizing said alkali metal sulfate as a feed into said furnace.

2. The process of claim 1 wherein stack gas from (c) is utilized as a source of $CO_2$ in (g).

3. The process of claim 1 wherein at least a portion of the chloride stream from (g) is utilized in the chlorine dioxide generator in (i).

4. The process of claim 1 wherein the fibrous pulp is wood pulp.

5. The process of claim 1 wherein the alkali metal is sodium.

6. The process of claim 1 wherein the $ClO_2$ product from (i) is used to bleach pulp.

7. The process of claim 1 wherein the $ClO_2$ product is an aqueous solution of $ClO_2$.

8. The process of claim 1 wherein (b) is carried out in a brown stock washer and involves a wash.

9. The process of claim 1 wherein at least a portion of the $NaHCO_3$ produced in (g) is recausticized and utilized in a pulp bleaching sequence.

10. The process of claim 1 wherein at least a portion of the $NaHCO_3$ produced in (g) is recausticized and utilized as digestor liquor in (a).

11. The process of claim 1 wherein $NaHCO_3$ from (g) is elutriated to obtain a substantially pure $NaHCO_3$ product.

12. The process of claim 1 wherein sodium chloride is recovered in (g).

* * * * *